US006334468B1

(12) United States Patent
Friestad

(10) Patent No.: US 6,334,468 B1
(45) Date of Patent: Jan. 1, 2002

(54) FILL PORT ADAPTER FOR MEDICAL GAS CYLINDER VALVES

(75) Inventor: Michael E. Friestad, Rock Island, IL (US)

(73) Assignee: Litton Systems, Inc., Woodlands Hills, CA (US)

( * ) Notice: Subject to any disclaimer, the term of this patent is extended or adjusted under 35 U.S.C. 154(b) by 0 days.

(21) Appl. No.: 09/654,916

(22) Filed: Sep. 5, 2000

(51) Int. Cl.[7] ..... B65B 1/04; B65B 3/04

(52) U.S. Cl. ..... 141/3; 141/18; 141/346; 141/348; 141/370; 141/372; 141/378; 141/383; 137/614.06

(58) Field of Search ..... 141/2, 3, 4, 18, 141/20, 39, 311 R, 312, 346, 348, 349, 350, 367, 369, 370, 372, 378, 383, 386; 137/614.06; 251/149.9

(56) References Cited

U.S. PATENT DOCUMENTS 5,908,053 A * 6/1999 Byrd ..... 141/18

* cited by examiner

*Primary Examiner*—Timothy L. Maust
(74) *Attorney, Agent, or Firm*—Lowe Hauptman Gilman & Berner, LLP

(57) ABSTRACT

The present invention allows an additional connection to a standard medical gas cylinder valve such as a CGA-870 valve. An additional connection may be used for filling a cylinder without removing the pressure reducer, simultaneous filling while drawing through the pressure reducer, or for any other purpose that requires an additional or non-standard connection to the cylinder. The additional connection will be through an adapter that screws into the burst disc port. Some gas cylinder valves have the burst disc center line closer to the outlet centerline. This close centerline may be accommodated by offsetting the access of the first and second port to provide clearances required.

17 Claims, 1 Drawing Sheet

FILL PORT ADAPTER FOR MEDICAL GAS CYLINDER VALVES

FIELD OF THE INVENTION

The present invention relates generally to valves used with medical gas cylinders, and more particularly, to a valve used to add additional connection port or ports to an existing gas cylinder valve without altering the gas cylinder valve and without altering or removing the existing regulator or gas delivery hardware.

BACKGROUND OF THE INVENTION

Medical gas cylinder valves have three ports when manufactured according to an industry standard, for example, Compressed Gas Association (CGA) 870). One port is screwed into the gas cylinder, a second port is where the regulator or gas delivery is attached, and the third port contains a pressure relief safety burst disc. As depicted in FIG. 1, a typical configuration for a medical gas cylinder is depicted. The medical gas cylinder 10 has a single fill port through a conventional valve 12. The conventional valve 12 usually has NPT threads on the outlet end. As depicted in FIG. 1, a CGA-870 valve is illustrated as 30. The CGA-870 valve has a body 32 having a first port 34 having NPT threads, a pressure reducer 36 attached to a second port 35 and a burst disc 38 in a third port 37.

Often, the number of ports on a medical gas valve such as the CGA-870 is insufficient. Thus, a need exists in the art for an apparatus used to add at least one port to the CGA-870 gas valve without altering the regulator or gas delivery hardware.

SUMMARY OF THE INVENTION

It is an object of the present invention to provide a device for attachment to a standard medical gas cylinder that provides an additional connection port.

Another object of the present invention is to add an additional connection port or ports to an existing gas cylinder valve.

Yet another object of the present invention is to add additional connection port or ports to an existing gas cylinder valve and without altering or removing the existing regulator or gas delivery hardware.

The present invention allows an additional connection to a standard medical gas cylinder valve such as a CGA-870 valve. An additional connection may be used for filling a cylinder without removing the pressure reducer, simultaneous filling while drawing through the pressure reducer, or for any other purpose that requires an additional or non-standard connection to the cylinder. The additional connection will be through an adapter that screws into the burst disc port. A burst disc is a frangible disc which ruptures within a predetermined pressure range. Some gas cylinder valves have the burst disc center line closer to the outlet centerline. This close centerline may be accommodated by offsetting the access of the first and second port to provide clearances required.

These and other objects of the present invention are achieved by a fill port adapter for connection to a medical gas cylinder having two or more ports. The fill port adapter includes a body having a first connector portion for pressure tight connection into one of the two or more ports of the medical gas cylinder. The fill port adapter has a burst disc portion including a burst disc. The fill port adapter has a second connector portion having connection means to either fill the gas cylinder from a source of gas pressure through a second connector portion or to withdraw gas from the gas cylinder through the second connector portion.

The foregoing and other objects of the present invention can be achieved by a method of adding an additional port to an existing medical gas cylinder having two or more ports. The method includes disconnecting hardware from one of the two or more ports and connecting an adapter including a first connector portion for pressure tight connection into one of the two or more ports of the medical gas cylinder. The adapter also includes a burst disc portion including a burst disc, and a second connector portion having connection means to either fill the gas cylinder from a source of gas pressure through the second connector portion or to withdraw gas from the gas cylinder through the second connector portion.

The foregoing and other objects of the present invention can be achieved by a fill port adapter for connection to a medical gas cylinder having two or more ports. The fill port adapter includes a body including a first connector portion for pressure tight connection into one of the two or more ports of the medical gas cylinder. The fill port adapter has a burst disc portion including a burst disc, wherein the port into which the first connector portion is connected is a burst disc port. The fill port adapter has a second connector portion having connection means to either fill the gas cylinder from a source of gas pressure through the second connection portion or to withdraw gas from the gas cylinder through the second connector portion.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE PRESENT INVENTION

Figure 2:
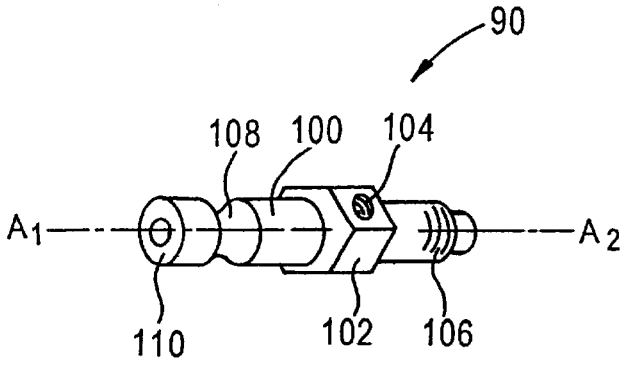
FIG. 2 is a perspective illustration of an adapter providing an additional port according to the present invention.

An adapter 90 according to the present invention is depicted in perspective in FIG. 2. As depicted in FIG. 2, the adapter 90 has a generally cylindrical body 100 having a central section 102 which includes female NPT threads for connection to a burst disc 38. An inlet section 106 has male NPT threads. An outlet section 108 can have a quick disconnect 110, NPT threads or any other configuration as desired. The section 108 adds the additional port when connected to the CGA-870 valve 30.

Figure 1:
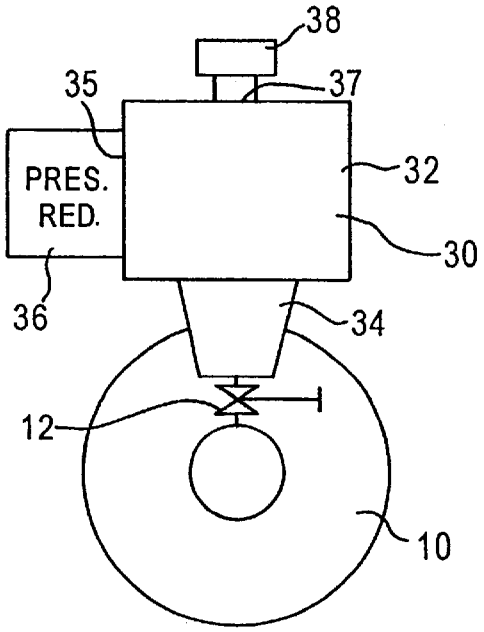
FIG. 1 (PRIOR ART)
FIG. 1 is an illustration of a conventional prior art CGA-870 valve connected to a standard medical gas cylinder.
Figure 3:
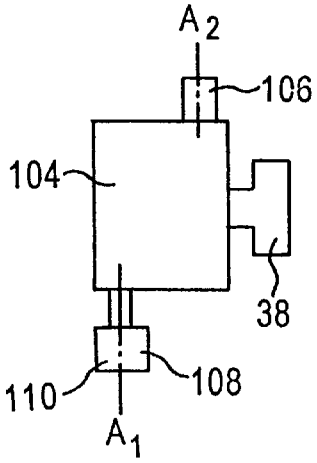
FIG. 3 is an illustration of a second embodiment of an adapter according to the present invention having the axes offset between the first and third ports.
Figure 4:
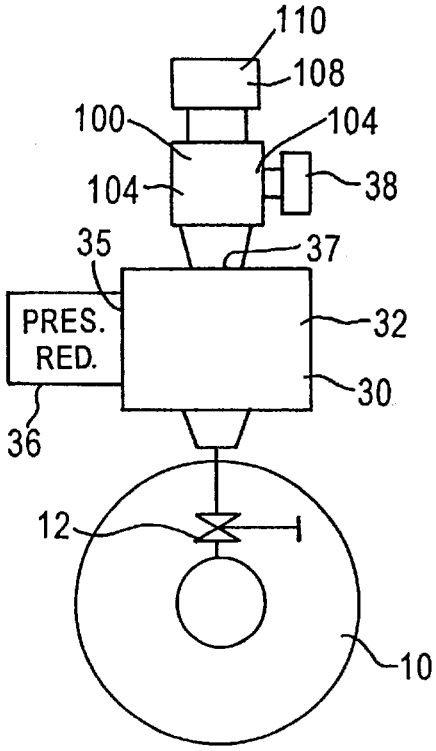
FIG. 4 is an illustration of a conventional medical gas cylinder, CGA-870 valve and the present invention connected to one of the three ports on the CGA-870 valve.

As depicted in FIG. 3, a second embodiment of the present invention has the first section 106 which is offset from the outlet section 108. This is to accommodate some gas cylinder valves that have the burst disc center line closer to the outlet centerline. As depicted in FIG. 2, the centerline A1–A2 is along a single axis. By contrast, as depicted in FIG. 3, the centerline A1–A2 are offset from each other. As depicted in FIG. 4, the burst disc 38 in FIG. 1 has been replaced with the adapter assembly 96 according to the present invention. The burst disc 38 which was previously in port 37 is now in port 104 of the adapter.

Advantageously, the present invention provides an apparatus and a method for adding at least one port to the gas valve without altering the regulator or gas delivery hardware. Although two configurations are depicted for the adapter 90, it should be apparent that other port configurations could be used to allow connection to various different gas plumbing systems as desired. In the configurations depicted in FIGS. 2 and 3, a quick disconnect 110 is attached to the adapter body 104. This configuration would advantageously allow simultaneous gas cylinder filling while gas can still be delivered through the existing regulator or gas delivery hardware. This configuration is only one of many possible configurations.

It should now be apparent that an invention has been described which allows additional connection port or ports to an existing gas cylinder valve without altering the gas cylinder valve and without altering or removing the existing regulator or gas delivery hardware.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A fill port adapter for connection to a medical gas cylinder having a burst disc port, comprising:

a body including:

a first connector portion configured for pressure tight connection into the burst disc port of the medical gas cylinder;

a burst disc portion including a burst disc; and a second connector portion having connection means to either fill the gas cylinder from a source of gas pressure through said second connector portion or to withdraw gas from the gas cylinder through the second connector portion.

2. The fill port adapter of claim 1, wherein said first connector portion and said second connector portion are in alignment along a longitudinal axis of said body.

3. The fill port adapter of claim 1, wherein said first connector portion and said second connector portion are parallel with and offset relative to each other along a longitudinal axis of said body.

4. The fill port adapter of claim 1, wherein said burst disc portion extends at right angles relative to said first connector portion and said second connector portion.

5. The fill port adapter of claim 1, wherein said connection means includes NPT threads and a quick disconnect fitting.

6. The fill port adapter of claim 1, wherein said first connector portion includes male NPT threads.

7. A gas delivery system, comprising:

a gas cylinder;

a gas cylinder valve having a first port connected to the gas cylinder, a second port, and a burst disc port; and a fill port adapter comprising a body including a first connector portion connected to the burst disc port of the gas cylinder valve in a pressure-tight manner;

a burst disc portion including a burst disc which ruptures within a predetermined pressure range; and a second connector portion adapted to connect to at least one external gas delivery device.

8. The system of claim 7, further comprising a gas delivery hardware connected to the second port of the gas cylinder valve for withdrawing gas from the gas cylinder through the gas cylinder valve.

9. The system of claim 8, further comprising a source of gas pressure connected to the second connector portion of the adapter for simultaneously filing the gas cylinder while withdrawing gas from the gas cylinder without disconnecting the gas delivery hardware from the gas cylinder.

10. The system of claim 7, wherein the first port and burst disc port of the gas cylinder valve have center lines which are substantially aligned, and the first and second connector portions of the adapter have center lines parallel with and offset relative to each other.

11. The system of claim 7, wherein said body is generally cylindrical and has first and second ends axially spaced, the first and second connector portions are arranged at the first and second ends of said cylindrical body, respectively.

12. The system of claim 11, wherein the first and second connector portions have center lines in alignment along a longitudinal axis of said cylindrical body.

13. The system of claim 11, wherein the first and second connector portions have center lines parallel with and offset relative to each other along a longitudinal axis of said cylindrical body.

14. The system of claim 7, wherein the burst disc portion extends at right angles relative to the first and second connector portions.

15. The system of claim 7, wherein the second connector portion includes NPT threads and quick disconnect fitting.

16. The system of claim 7, wherein the first connector portion includes male NPT threads.

17. A method of adding an additional port to an existing medical gas cylinder having at least a burst disc port, comprising the steps of:

a) providing an adapter including:

a first connector portion configured for pressure tight connection into the burst disc port of the medical gas cylinder;

a burst disc portion including a burst disc; and a second connector portion having connection means to either fill the gas cylinder from a source of gas pressure through said second connector portion or to withdraw gas from the gas cylinder through the second connector portion;

b) disconnecting hardware from the burst disc port of the medical gas cylinder; and c) connecting the first connector portion of the adapter to the burst disc port of the medical gas cylinder.

* * * * *